US005890471A

United States Patent [19]

Nishimura

[11] Patent Number: 5,890,471

[45] Date of Patent: Apr. 6, 1999

[54] FUEL INJECTION DEVICE FOR ENGINES

[75] Inventor: Terukazu Nishimura, Fujisawa, Japan

[73] Assignee: Isuzu Motors Limited, Tokyo, Japan

[21] Appl. No.: 917,715

[22] Filed: Aug. 27, 1997

[30] Foreign Application Priority Data

Aug. 31, 1996 [JP] Japan ..... 8-249087

[51] Int. Cl.[6] ..... F02M 37/04

[52] U.S. Cl. ..... 123/496; 123/467

[58] Field of Search ..... 123/496, 467, 123/299, 300, 506

[56] References Cited

U.S. PATENT DOCUMENTS

| | | | |
|---|---|---|---|
| 4,603,671 | 8/1986 | Yoshinaga | 123/467 |
| 4,798,186 | 1/1989 | Ganser | 123/467 |
| 5,156,132 | 10/1992 | Iwanaga | 123/467 |
| 5,605,134 | 2/1997 | Martin | 123/467 |
| 5,664,545 | 9/1997 | Kato | 123/467 |
| 5,669,355 | 9/1997 | Gibson | 123/467 |
| 5,694,903 | 12/1997 | Ganser | 123/496 |
| 5,711,277 | 1/1998 | Fuseya | 123/467 |

FOREIGN PATENT DOCUMENTS

| | | |
|---|---|---|
| 2-161165 | 6/1990 | Japan . |
| 3-000964 | 1/1991 | Japan . |
| 4-012165 | 1/1992 | Japan . |
| 6-108948 | 4/1994 | Japan . |

*Primary Examiner*—Carl S. Miller
*Attorney, Agent, or Firm*—Browdy and Neimark

[57] ABSTRACT

This fuel injection device changes stepwise the effective opening area of the exhaust opening that releases the fuel pressure in the balance chamber, in order to control the lift velocity of the needle valve to give flexibility to the pattern of the initial fuel injection rate. The fuel injection device of this invention switches the current value applied to the solenoid between the large and the small value to change the distance traveled by the solenoid valve and thereby change the opening degree of the exhaust port that releases the fuel pressure in the balance chamber. Because the return spring mechanism having plural springs, the magnitudes of current necessary to be applied to the solenoid to move the solenoid valve are clearly differentiated. This reduces variations in the process of releasing the fuel pressure in the balance chamber, assuring a stable fuel injection rate control. Further, if the amount of current is changed while the needle valve is being lifted, the initial fuel injection rate can be controlled in many ways.

8 Claims, 7 Drawing Sheets

FUEL INJECTION DEVICE FOR ENGINES

BACKGROUND OF THE INVENTION

1. Field of the Invention

The present invention relates to a fuel injection device applied to engines such as diesel engines or direct injection type gasoline engines.

2. Description of the Prior Art

Conventional fuel injection devices that control the amount of fuel injected into combustion chambers of engines, such as diesel engines, and injection timing include those disclosed in Japanese Patent Laid-Open Nos. 964/1991, 108948/1994, 161165/1990 and 12165/1992.

The fuel injection devices disclosed in the Japanese Patent Laid-Open Nos. 964/1991 and 108948/1994 have a needle valve that opens or closes nozzle holes formed at the front end of an injection nozzle and control the fuel injection by the balance between a force produced by a fuel pressure acting on the needle valve on the nozzle front side in a direction that opens the nozzle holes and a force produced by a fuel pressure in a balance chamber acting in a direction of closing the needle valve.

FIG. 6 shows an essential part of the above fuel injection devices including the balance chamber to control fuel injection. A balance chamber 62 is formed in a fuel injection device body 61 above a control piston 60 connected to the needle valve. The balance chamber 62 communicates with a supply passage 63 through which fuel is supplied from a fuel source and in which a throttle 64 is formed. An exhaust passage 65 for discharging fuel from the balance chamber 62 comprises a fuel passage 66 and an orifice 67. The orifice 67 is opened and closed by a solenoid valve 68 driven by a control signal from the control unit.

When the orifice 67 is opened by the solenoid valve 68, the fuel is released through the exhaust passage 65. Because the supply of fuel from the supply passage 63 is limited by the throttle 64, the fuel pressure in the balance chamber 62 decreases, causing the control piston 60 and therefore the needle valve to lift to inject fuel. When the orifice 67 is closed by the solenoid valve 68, the discharge of fuel from the exhaust passage 65 is stopped. As the fuel is supplied through the supply passage 63 and throttle 64, the fuel pressure in the balance chamber 62 recovers pushing down the control piston 60, causing the needle valve to close the nozzle holes to stop fuel injection.

As for the control of the needle valve lift speed, the fuel injection device disclosed in Japanese Patent Laid-Open No. 108948/1994 reduces an initial fuel injection rate by appropriately setting the cross-sectional area of a small hole or orifice that is a part of the exhaust passage formed in a pressure control member which is opened and closed by a solenoid valve in order to lift the needle valve slowly.

Japanese Patent Laid-Open Nos. 161165/1990 and 12165/1992 disclose fuel injection devices of an electromagnetic control type using a three-way valve. As shown in FIG. 7, a three-way valve 74 in these fuel injection devices switches, in response to a control signal from a control unit 89, between a passage 71 communicating with the balance chamber 70, a supply passage 72 connected to a fuel supply pump 80 through a common rail 81, and an exhaust passage 73 leading to a reservoir 82 to control the start and stop of the fuel injection. Fuel is supplied from the common rail 81 through a passage 84 to a space surrounding the needle valve 83. When the three-way valve 74 allows the balance chamber 70 to communicate with the exhaust passage 73 and at the same time closes the supply passage 72, the high pressure fuel in the balance chamber 70 leaks through the three-way valve 74 into the exhaust passage 73, lowering the fuel pressure in the balance chamber, which in turn causes the needle valve 83 to lift to inject fuel. The closure of the supply passage 72 prevents inflow of high pressure fuel into the balance chamber 70. When the three-way valve 74 allows the supply passage 72 to communicate with the passage 71 and closes the exhaust passage 73, the high fuel pressure recovers in the balance chamber 70, causing the needle valve 83 to move down to stop the fuel injection. This type of fuel injection device employs small-diameter and large-diameter command pistons 85, 86 and two return springs 87, 88 with different loads to control the initial fuel injection rate stepwise in the lift control of the needle valve 83.

In the fuel injection device of FIG. 6, in which a solenoid valve 68 as a two-way valve is installed in the exhaust passage 65 from the balance chamber 62 to control the opening and closing of the exhaust passage 65, however, the fuel pressure in the balance chamber 62 is uniquely determined by the ratio in cross-sectional area between the throttle 64 in the supply passage 63 leading to the balance chamber 62 and the orifice 67 in the exhaust passage 65. Further, once the throttle 64 and the orifice 67 are fabricated, their cross-sectional areas are practically impossible to be changed. Hence, it is not possible to control arbitrarily the fuel pressure in the balance chamber 62, i.e., the fuel injection pattern.

To describe in more concrete terms, because the fuel injection rate characteristic is determined by the diameter of the exhaust passage 65 of the balance chamber 62 and the spring load of the return spring, it is difficult to produce various fuel injection rate characteristics according to the operating condition of the engine. Further, since the fuel injection rate characteristic is determined by the diameter of the small orifice 67, there are limitations on the reduction in the needle valve lift speed and the initial injection rate. Further, because the throttle and the orifice diameter must be machined in manufacture of the fuel injection device, the constitutional parts will unavoidably have machining errors, which in turn cause variations among the products in the needle valve lift speed or the initial fuel injection rate.

In the fuel injection device of FIG. 7, too, since the fuel injection characteristic is uniquely determined by the cross-sectional area of the exhaust passage of the balance chamber and the spring load of the return spring, it is difficult to obtain finely regulated fuel injection characteristic according to the engine operating condition.

The conventional fuel injection devices therefore cannot flexibly control the fuel injection characteristic, such as the amount of fuel to be injected and the fuel injection timing, according to the engine operating conditions. Under these circumstances, there is a growing demand for a fuel injection control that can change the control pattern of the initial fuel injection rate.

SUMMARY OF THE INVENTION

The object of this invention is to solve the problems mentioned above and to provide a fuel injection device for engines, in which a control means to open and close an exhaust passage for releasing the fuel pressure in the balance chamber comprises a solenoid valve having a solenoid to produce an electromagnetic force for opening an exhaust port of the exhaust passage and a return spring mechanism to apply a spring force to the solenoid valve to close the exhaust port, and in which when the solenoid is energized to cause the solenoid valve to open the exhaust passage, magnitudes of electric currents supplied to the solenoid to move the solenoid valve against the force of the return spring mechanism are differentiated significantly to alleviate instability of initial fuel injection rate caused by unavoidably occurring various errors, such as dimensional errors and variations of spring force, and thereby make it possible to reduce the initial fuel injection rate.

A fuel injection device for engines of this invention comprises: a device body having nozzle holes at the front end thereof for injecting fuel; a control sleeve fixed in a hollow portion of the device body; a valve assembly having an end thereof inserted into a hole in the control sleeve, the end forming a pressure receiving surface, the valve assembly including a needle valve reciprocally movable in the hollow portion of the device body and adapted to open and close the nozzle holes; a balance chamber formed by the hole of the control sleeve and the pressure receiving surface of the valve assembly to control a lift of the valve assembly; a supply passage formed in the control sleeve to supply a fuel pressure to the balance chamber; an exhaust passage formed in the control sleeve to release the fuel pressure from the balance chamber; and a control means to open and close the exhaust passage; wherein the control means includes a solenoid valve having a solenoid to produce an electromagnetic force to open an exhaust port of the exhaust passage and a return spring mechanism having springs to apply spring forces to the solenoid valve to close the exhaust port; wherein an effective opening area of the exhaust port of the exhaust passage opened by the solenoid valve is set smaller than a minimum cross-sectional area of the exhaust passage.

In this fuel injection device, when the solenoid is not energized, the solenoid valve is urged by the force of the return spring mechanism to close the exhaust port. Because the fuel pressure supplied from the supply passage to the balance chamber acts, without being reduced, on the pressure receiving surface, the valve assembly whose pressure receiving end is inserted in the hole of the control sleeve closes the nozzle holes formed in the front end of the device body. Energizing the solenoid causes the solenoid valve to move against the return force of the return spring mechanism. As the solenoid valve moves, the exhaust port of the exhaust passage formed in the control sleeve is opened, releasing the fuel pressure in the balance chamber, which in turn lifts the valve assembly to inject fuel from the nozzle holes.

By changing the magnitude of electric current supplied to the solenoid of the solenoid valve, it is possible to change the opening degree of the exhaust port opened by the solenoid valve and therefore the reduction speed of the fuel pressure in the balance chamber, i.e., the lift speed of the needle valve, thereby stabilizing various injection rate characteristics, particularly the initial injection rate characteristics.

In other words, when the current supplied to the solenoid of the solenoid valve is small, the electromagnetic force generated is small and the opening degree of the exhaust port of the exhaust passage opened by the solenoid valve is small. As a result, the reduction speed of the fuel pressure in the balance chamber is moderate and thus the lift velocity of the needle valve is also moderate. Hence the initial injection rate slowly increases.

When on the other hand the current supplied to the solenoid is increased, the electromagnetic force generated becomes large increasing the distance that the solenoid valve moves against the spring forces of the springs and therefore the opening degree of the exhaust port. As a result, the fuel pressure in the balance chamber decreases sharply, increasing the lift velocity of the needle valve and causing a sharp rise in the initial injection rate.

Because the effective opening area of the exhaust port of the exhaust passage opened by the solenoid valve is set smaller than the minimum cross-sectional area of the exhaust passage, the magnitude of the fuel pressure in the balance chamber is determined not by the minimum cross-sectional area of the exhaust passage, but by the effective opening area of the exhaust port opened and closed by the solenoid valve assembly. Hence, by changing the magnitude of current supplied to the solenoid, i.e., the effective opening area of the exhaust port, it is possible to change the lift velocity of the needle valve and therefore the pattern of the initial fuel injection rate.

This means that the degree of freedom of controlling the fuel injection rate, particularly the initial fuel injection rate, is substantially improved, which in turn reduces NOx emissions and noise level of the engine. If there are variations among individual fuel injection devices, the device of this invention can reduce the influences of variations by feeding back the actual lift of the needle valve.

The return spring mechanism may comprise a first return spring that applies a force to the solenoid valve in a direction of closing the exhaust port and a second return spring that, when the solenoid valve moves more than a predetermined distance, applies a force to the solenoid valve in a direction of closing the exhaust port. In this case, when the solenoid valve moves less than a predetermined distance, the return spring force of the return spring mechanism is determined only by the first return spring. When the solenoid valve is displaced more than a predetermined distance, the return spring force of the return spring mechanism is determined by a combined force of the first return spring and the second return spring. The first return spring and the second return spring may have the same spring constants or different ones.

The first return spring is installed, with an initial compression, between the device body and a first spring retainer always in contact with the solenoid valve. The second return spring is installed between the device body and a second spring retainer that, when the solenoid valve travels more than the predetermined distance, contacts the solenoid valve. In the fuel injection device of the above construction, when the current supplied to the solenoid is increased to cause the solenoid valve to travel more than the predetermined distance, the combined return force of the first return spring and the second return spring applied to the solenoid valve is greater than the return force of only the first return spring. This means that in terms of the magnitude of the current supplied to the solenoid, the current value required to move the solenoid valve against the force of only the first return spring needs to be differentiated definitely from the current value required to move the solenoid valve more than the predetermined distance against the force of the second return spring as well as the first return spring. Hence, to change the lift speed of the needle valve requires a definite change in the magnitude of the current supplied to the solenoid of the solenoid valve. This prevents the lift speed of the needle valve from being affected greatly by small variations in the supply current, allowing the control on the lift speed of the needle valve to be performed reliably and easily.

A predetermined time after the start of fuel injection in the initial stage of the fuel injection cycle, the current applied to the solenoid is switched from a small current to a large current. The small current is high enough to cause the solenoid valve assembly to move against the force of only the first return spring and the large current is high enough to cause the solenoid valve assembly to move against the combined force of the first and second return springs. Because the lift speed of the needle valve can be changed from the initial moderate lift speed to a relatively fast lift speed in the initial stage of the fuel injection cycle, it is possible to obtain various initial fuel injection rates according to the operating conditions of the engine.

The balance chamber is formed by the hole in the control sleeve fixed in the hollow portion of the device body and by the pressure receiving surface of the valve assembly, and the supply passage and the exhaust passage are formed in the control sleeve. This arrangement allows major structures for control of fuel injection rate of the fuel injection device, such as balance chamber, fuel chamber and fuel pressure supply and exhaust passages, to be concentrated in the control sleeve, thereby simplifying the construction and assembly of the fuel injection device, contributing to cost reduction.

DETAILED DESCRIPTION OF THE EMBODIMENT

Embodiments of the fuel injection device according to this invention will be described by referring to the accompanying drawings.

Figure 1:
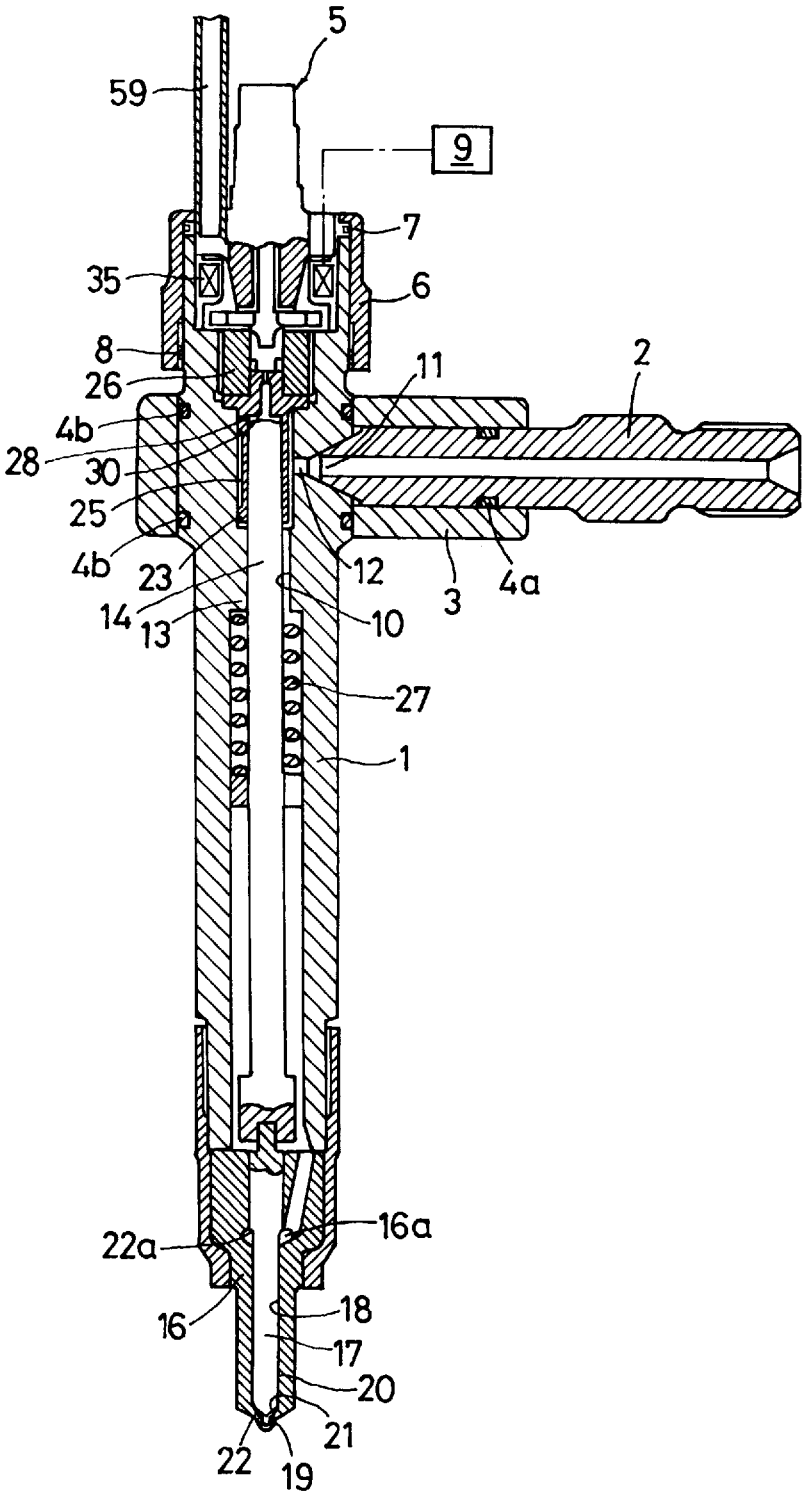
FIG. 1 is a cross section showing one embodiment of the fuel injection device for engines of this invention.

This fuel injection device is applied to a common rail injection system or an accumulator injection system (not shown). Fuel, which is supplied from the fuel injection pump through a common passage or a pressure accumulation chamber (referred to as a common rail), is injected into each combustion chamber in the engine. First, referring to FIG. 1, a body 1 of the fuel injection device is hermetically installed in a hole (not shown) formed in a base such as a cylinder head with a sealing member interposed. The device body 1 has a nozzle hermetically secured at the lower end thereof.

A fuel inlet plug 2 is attached to a bracket 3 provided in the upper part of the device body 1. The seal between the device body 1 and fuel inlet plug 2 and the bracket 3 is provided by seal members 4*a*, 4*b*. A solenoid valve 5 as an on-off two-way solenoid valve is secured to the upper part of the device body 1 by screwing a sleeve nut 6 over a threaded portion of the device body 1. Seal members 7, 8 are provided between the solenoid valve 5 and device body 1 and the sleeve nut 6. The fuel from the common rail (not shown) as a high pressure fuel source is supplied through the fuel inlet plug 2 into this fuel injection device. An electric current supplied to a solenoid described later to activate the solenoid valve 5 is supplied as a control current from a control unit 9. The device body 1 is formed with a hollow portion 10 that accommodates a control piston 14 reciprocally movable therein and with a fuel supply hole 12 that allows a fuel inlet 11 of the fuel inlet plug 2 to communicate with the hollow portion 10. At almost the central part of the hollow portion 10 of the device body 1 is formed a guide portion 13 whose diameter is contracted and through which the control piston 14 is slidably passed. A nozzle body 16 constituting a part of the device body 1 has a hole 18 communicating with the hollow portion 10. A needle valve 17 connected to the control piston 14 is slidably inserted in the hole 18 with a clearance 20 therebetween. The control piston 14 and the needle valve 17 together form a valve assembly that reciprocates in the device body 1. The clearance 20 formed around the needle valve 17 constitutes a passage for high pressure fuel. The nozzle body 16 has nozzle holes 19 formed at the front end thereof to inject fuel into the combustion chamber of the internal combustion engine. The needle valve 17 has a tapered surface 22 at the front end that can be seated on a seat surface 21 of the nozzle body 16. When the tapered surface 22 engages with the seat surface 21, the needle valve 17 closes the nozzle holes 19. The tapered surface 22 at the front end of the needle valve 17 and a tapered surface 22 of the needle valve 17 situated at a fuel reservoir 16*a* form first pressure receiving surfaces 22 of the valve assembly, and the fuel pressure acting on the first pressure receiving surfaces 22 produces a force urging the valve assembly in the upward direction of the drawing. When the needle valve 17 lifts and the tapered surface 22 parts from the seat surface 21, the high pressure fuel is injected from the nozzle holes 19 into the combustion chamber.

Figure 2:
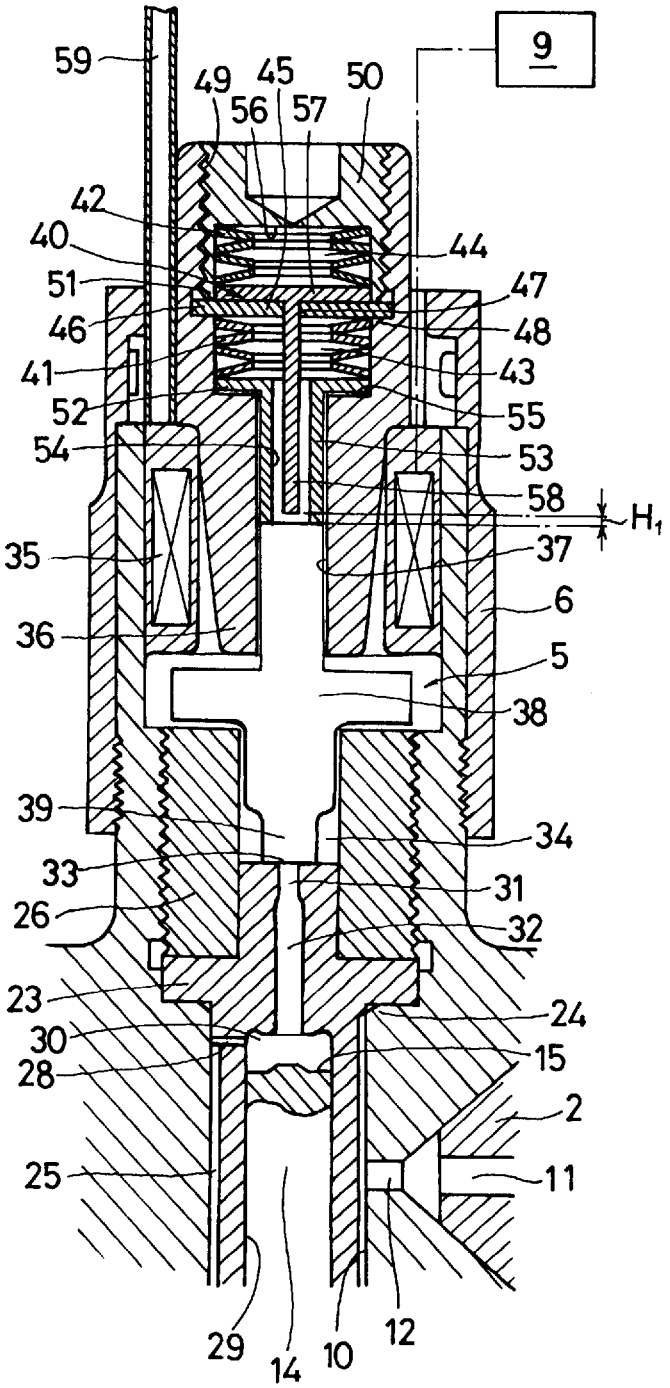
FIG. 2 is an enlarged cross section showing an essential part of the fuel injection device of FIG. 1, with an exhaust port closed.
Figure 3:
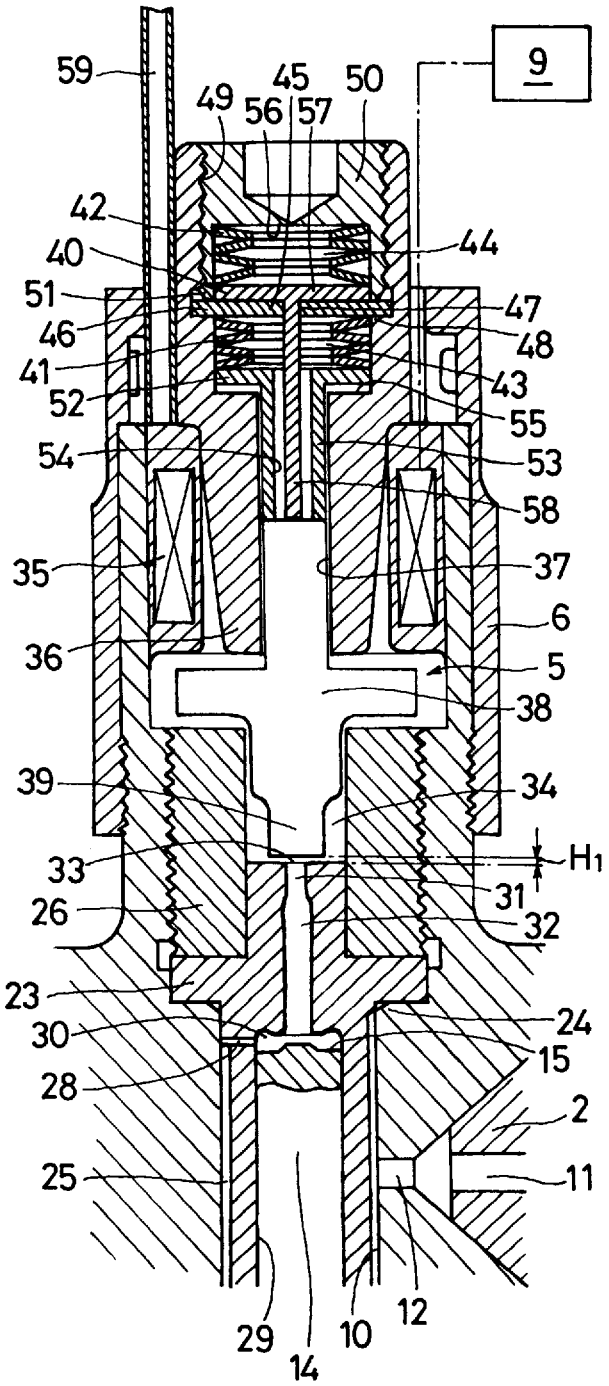
FIG. 3 is an enlarged cross section showing an essential part of the fuel injection device of FIG. 1, with a solenoid valve assembly driven against only a first return spring to open the exhaust port.
Figure 4:
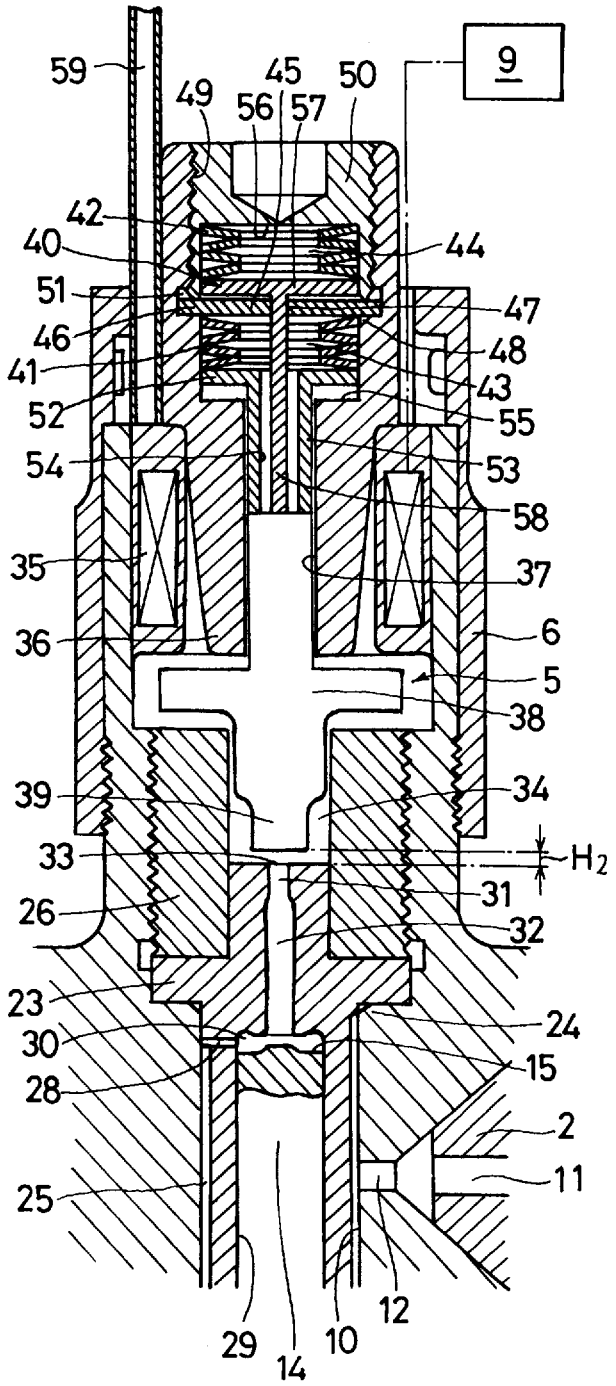
FIG. 4 is an enlarged cross section showing an essential part of the fuel injection device of FIG. 1, with a solenoid valve assembly driven against a second return spring as well as a first return spring to open the exhaust port to its maximum.

As shown in FIG. 2, 3 and 4, in the hollow portion 10 of the device body 1 is installed a control sleeve 23, and at an upper stepped portion in the hollow portion 10 is formed a seal surface 24 on which a shoulder portion of the control sleeve 23 rests. An annular fuel chamber 25 is formed between the outer circumferential surface of the control sleeve 23 and the hollow portion 10. The control sleeve 23 is held immovable in the hollow portion 10 by a plug 26 that is screwed into a threaded portion of the upper end part of the device body 1 and which has a hollow chamber 34 therein. The annular fuel chamber 25 communicates with the fuel inlet 11 of the fuel inlet plug 2 through the fuel supply hole 12 formed in the device body 1. The control sleeve 23 has a hole 29 therein that opens toward its front end and in which the control piston 14 is slidably inserted, with a balance chamber 30 formed in the upper part of the hole 29 by the hole 29 and a top surface 15 of the control piston 14. The top surface 15 of the control piston 14 constitutes a second pressure receiving surface that receives the fuel pressure in the balance chamber 30. In the control sleeve 23 is formed an exhaust passage including an orifice 31 and a fuel passage 32, with one end of the exhaust passage communicating with the balance chamber 30 and the other end having an exhaust port 33 communicating with the hollow chamber 34.

Further, the control sleeve 23 has a supply passage 28 allowing communication between the balance chamber 30 and the annular fuel chamber 25. The fuel supplied from the fuel inlet plug 2 through the fuel supply hole 12 to the annular fuel chamber 25 is further fed into the balance chamber 30 through the supply passage 28 which has a throttle function. The fuel pressure in the balance chamber 30 acts on the top surface 15 of the control piston 14, which is the second pressure receiving surface, to urge the valve assembly toward the nozzle end. The force produced by the fuel pressure in the balance chamber 30 controls the lift of the valve body based on the balance between the fuel pressure acting on the first pressure receiving surfaces 22, 22*a* and a return force of a return spring 27 acting on the valve assembly.

In the solenoid valve 5 a solenoid 35 surrounds a fixed core 36 in circle. The fixed core 36 has at its center a piercing hole 37 whose axis is aligned with that of the hollow chamber 34 of the plug 26. The solenoid 35 is supplied with an electric current as a control signal, whose magnitude is regulated, from the control unit 9. In the piercing hole 37 is inserted and guided axially reciprocally movable an armature 38 whose front end forms a valve assembly portion 39 that opens and closes the exhaust port 33. When a current is not supplied to the solenoid 35 of the solenoid valve 5, the spring force of a return spring mechanism 40 described later causes the valve assembly portion 39 to close the exhaust port 33. When the solenoid 35 is energized, the armature 38 is pulled up against the spring force of the return spring mechanism 40 causing the valve assembly portion 39 to open the exhaust port 33, releasing the fuel pressure from the balance chamber 30 through the exhaust passage into the hollow chamber 34.

The return spring mechanism 40 comprises a first return spring 41 and a second return spring 42. The first return spring 41 is a coned (i.e. cone-shaped) disc spring installed in a first hollow chamber 43 formed inside the fixed core 36. The second return spring 42 is a coned disc spring accommodated in a second hollow chamber 44 formed in a fixing plug 50. The first hollow chamber 43 and the second hollow chamber 44 are isolated by a partition plate 45. A peripheral portion 46 of the partition plate 45 is placed on a stepped portion 48 of the fixed core 36. When the fixing plug 50 is screwed into an inner threaded portion 49 of the fixed core 36, a cylindrical front end portion 51 of the fixing plug 50 presses the partition plate 45 against the stepped portion 48 of the fixed core 36 thus securely clamping the partition plate 45 therebetween. The first return spring 41 and the second return spring 42 may have the similar spring coefficients.

As is clearly visible in FIG. 2, the first return springs 41 and the second return springs 42 are in tandem, that is, they are disposed at different positions along the axial direction of the valve. The axial direction is the direction of the force applied to the armature 38 by the solenoid 35, the direction of motion of the assembly portion 39 at the bottom of the armature, which opens and closes the exhaust port 33, and the direction of motion of other parts such as the control piston 14.

The first return spring 41 has its upper end in contact with the partition plate 45 and its lower end in contact with a first spring retainer 52 and is always compressed. The first spring retainer 52 has a cylindrical portion 53 that extends into the piercing hole 37 and whose front end is always in contact with the armature 38 to urge the valve assembly portion 39 in a direction that closes the exhaust port 33. Hence, the first spring retainer 52 can be moved up and down while deflecting the first return spring 41. The first spring retainer 52, however, is not in contact with a bottom portion 55 of the first hollow chamber 43 even when the valve assembly portion 39 is at the lowest position (FIG. 2) closing the exhaust port 33.

The second return spring 42 has its upper end in contact with an inner bottom 56 of the fixing plug 50 and its lower end in contact with a second spring retainer 57. When the solenoid valve 5 closes the exhaust port 33, the second return spring 42 may be in a free state where the second spring retainer 57 is in contact with the partition plate 45 but is not urged against it or in a compressed state, as in the case with the first return spring 41, where the second spring retainer 57 is pressed against the partition plate 45. A rod portion 58 of the second spring retainer 57 passes through a hole 47 of the partition plate 45 and extends into a hollow space 54 of the cylindrical portion 53 of the first spring retainer 52. Hence, the second spring retainer 57, as with the first spring retainer 52, can be moved up and down while deflecting the second return spring 42. When the exhaust port 33 is closed, i.e., the first return spring 41 lowers the first spring retainer 52 to the lowest position, the front end of the rod portion 58 is situated a distance $H_1$ above the front end of the cylindrical portion 53 of the first spring retainer 52 so that it does not contact the armature 38. At the top of the solenoid valve 5 is provided a fuel return pipe 59 that extends from the sleeve nut 6 and communicates with the hollow chamber 34. While the first return spring 41 and the second return spring 42 have been described as coned disc springs, they may be other forms of spring means, such as coil springs.

When the valve assembly portion 39 opens the exhaust port 33, the fuel pressure in the balance chamber 30 is released through the fuel passage 32, orifice 31 and hollow chamber 34 into the fuel return pipe 59. The fuel pressure in the balance chamber 30 decreases as it is released. When the force generated by the fuel pressure acting on the first pressure receiving surfaces 22 to urge the needle valve 17 upward becomes greater than the sum of the force of the return spring 27 urging the control piston 14 downward and the force generated by the fuel pressure in the balance chamber 30 acting on the top surface 15 (second pressure receiving surface) to push down the control piston 14, the needle valve 17 is lifted.

This embodiment constructed as described above operates as follows.

When the solenoid 35 is not energized, the first return spring 41 urges the armature 38 downward through the cylindrical portion 53 of the first spring retainer 52, with the exhaust port 33 closed by the valve assembly portion 39, as shown in FIG. 2. In this condition the high pressure fuel from the common rail is supplied through the fuel inlet plug 2 to the fuel inlet 11. The fuel supplied to the fuel inlet 11 through the fuel inlet plug 2 enters into the clearance 20 formed between the outer circumferential surface of the needle valve 17 and the nozzle body 16. The clearance 20 is thus filled with the high pressure fuel. The high pressure fuel from the fuel inlet 11 enters through the fuel supply hole 12 into the annular fuel chamber 25, from which it is further supplied to the balance chamber 30 through the supply passage 28. At this time, the resultant force generated by the fuel pressure in the balance chamber 30 to urge the control piston 14 toward the front end side and the return force of the return spring 27 is greater than the force generated by the fuel pressure acting on the first pressure receiving surfaces 22 (tapered surfaces) that urges the needle valve 17 to open. So, the needle valve 17 closes the nozzle holes 19 and the fuel injection is not performed. At this time, the second return spring 42 presses the second spring retainer 57 against the partition plate 45 and the rod portion 58 of the second spring retainer 57 is situated a distance $H_1$ from the armature 38, so that the second return spring 42 does not apply any return force to the armature 38.

When a small current as the control current is supplied from the control unit 9 to the solenoid 35, the armature 38 is pulled upward against the spring force of the first return spring 41 to travel the distance $H_1$, causing the valve assembly portion 39 to open the exhaust port 33, as shown in FIG. 3. The electromagnetic force of the solenoid 35, however, is not large enough to move the armature 38 against the force of the second return spring 42, so that the armature 38, after moving the distance $H_1$, stops when it abuts against the rod portion 58 of the second spring retainer 57. When the exhaust port 33 is open, the fuel pressure in the balance chamber 30 is released through the fuel passage 32 and the orifice 31 into the hollow chamber 34. When the fuel pressure in the balance chamber 30 is released, the force generated by the fuel pressure acting on the first pressure receiving surfaces 22 to urge the needle valve 17 to open overcomes the resultant force generated by the fuel pressure acting on the top surface 15 (second pressure receiving surface) of the control piston 14 to urge the control piston 14 toward the front end side and the return force of the return spring 27. As a result, the needle valve 17 lifts, opening the nozzle holes 19 to inject fuel into the combustion chamber. At this time, the effective opening area of the exhaust port 33 is determined based on the distance $H_1$ and is smaller than the minimum cross-sectional area of the exhaust passage, i.e., the cross-sectional area of the orifice 31 in the case of this embodiment. Hence, the amount of the fuel pressure released from the balance chamber 30 through the exhaust passage is determined by the effective opening area of the exhaust port 33.

Next, when a large current as the control current from the control unit 9 is supplied to the solenoid 35, the armature 38 moves a distance $H_2$, as shown in FIG. 4. That is, after abutting against the rod portion 58 of the second spring retainer 57, the armature 38 is moved against the spring force of the first return spring 41 and the spring force of the second return spring 42, causing the valve assembly portion 39 to move the distance $H_2$ and open the exhaust port 33 further. During the upward movement of the armature 38 after having moved the distance $H_2$, the effective opening area of the exhaust port 33 is still smaller than the cross-sectional area of the orifice 31, which means that the amount of fuel pressure released through the exhaust passage is still determined by the effective opening area of the exhaust port 33. When the effective opening area of the exhaust port 33 is large, the fuel pressure in the balance chamber 30 is rapidly released through the fuel passage 32 and the orifice 31 into the hollow chamber 34. Therefore, the upward movement of the needle valve 17 also becomes quick, performing the fuel injection at a large injection rate. Selection between large and small currents may be made by an appropriate means such as a pulse width modulation means, which changes the amount of current supplied to the solenoid 35.

When the current supply from the control unit 9 to the solenoid 35 is cut off, the armature 38 receives a return force either from the first return spring 41 or from a combination of the first return spring 41 and the second return spring 42, depending on the distance traveled by the armature 38 (corresponding to $H_1$ or $H_2$), causing the valve assembly portion 39 to close the exhaust port 33 by the force of the first return spring 41. The fuel pressure in the balance chamber 30 is then recovered by the fuel supply from the supply passage 28, forcing the needle valve 17 to close the nozzle holes 19, stopping the fuel injection.

Figure 5:
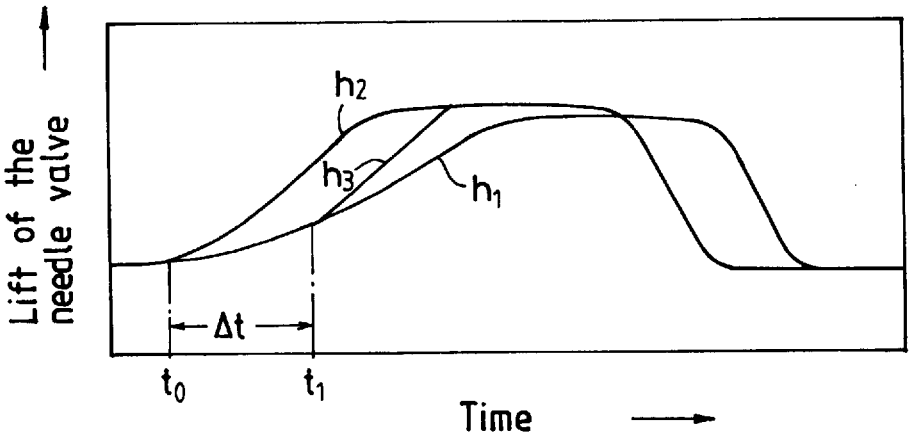
FIG. 5 is a graph showing the lift of the needle valve that changes over time during the fuel injection cycle.
Figure 6:
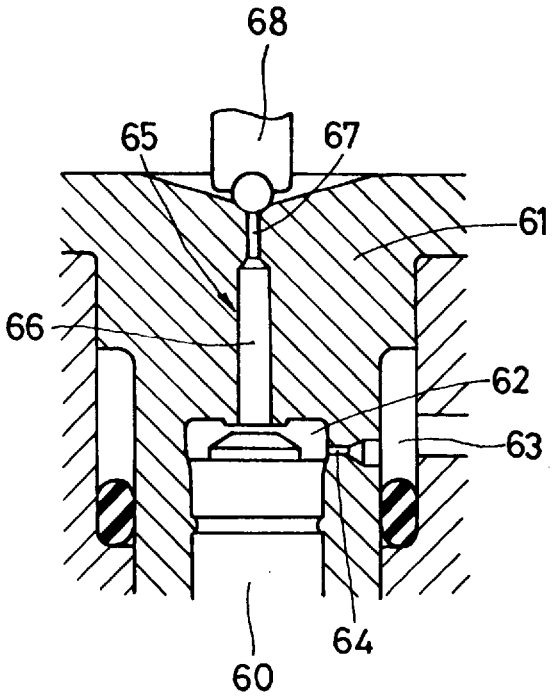
FIG. 6 (PRIOR ART)
FIG. 6 is a cross section of a conventional fuel injection device showing a balance chamber and its surrounding portion.
Figure 7:
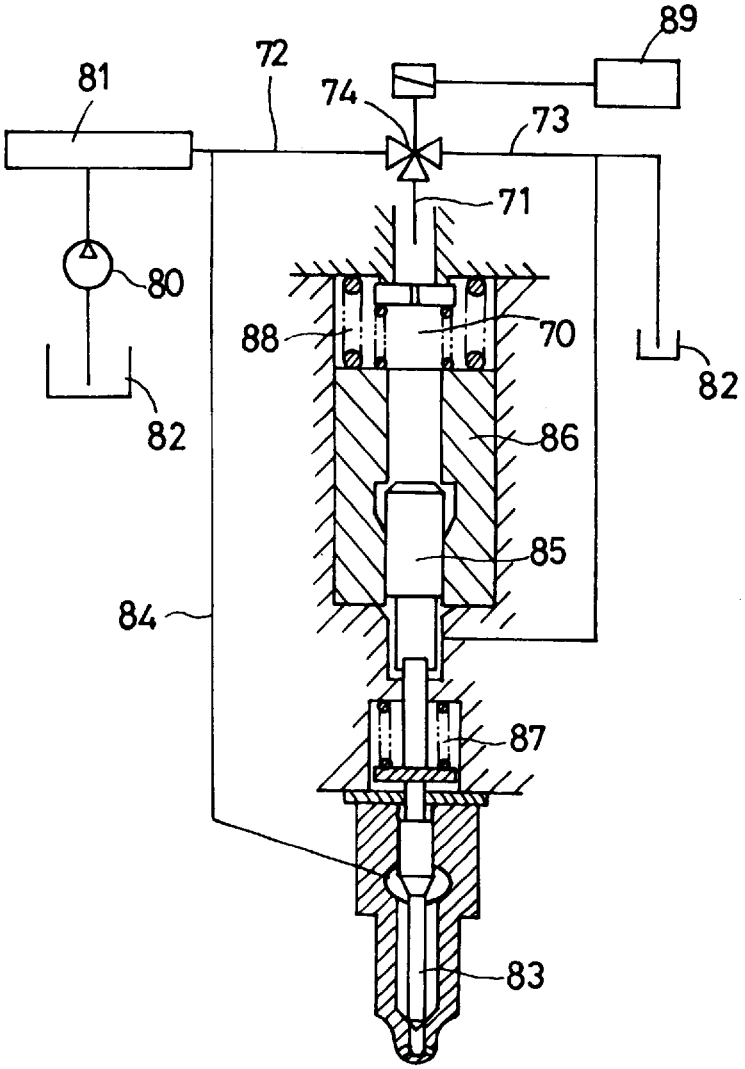
FIG. 7 (PRIOR ART)
FIG. 7 is a schematic diagram showing another conventional fuel injection device.

FIG. 5 shows the lift of the needle valve in the fuel injection cycle. At time to, the solenoid 35 is energized to open the exhaust port 33, after which the fuel pressure in the balance chamber 30 begins to decrease. As a result, the lift of the needle valve 17 starts to increase. When the current supplied to the solenoid 35 is small, the effective opening area of the exhaust port 33 is small so that reduction in the fuel pressure in the balance chamber 30 is moderate. The lift of the needle valve 17 therefore increases slowly, as shown by a curve $h_1$, and in the initial stage of fuel injection the fuel injection rate is small and the rate of its increase is moderate. When the current applied to the solenoid 35 is large, the effective opening area of the exhaust port 33 is large, which in turn causes a sharp drop in the fuel pressure in the balance chamber 30. The lift of the needle valve 17 therefore increases sharply as indicated by a curve $h_2$, and in the initial stage of fuel injection the fuel injection rate is large and the rate of its increase is steep. When, at time $t_1$ in the initial stage of fuel injection, the current applied to the solenoid 35 is increased, the lift sharply increases, as shown by the curve $h_3$, from some point on the curve $h_1$ at the same steepness as the curve $h_2$. By properly selecting the time $t_1$ at which the current applied to the solenoid 35 is switched from a small to a large value, it is possible to obtain a desired lift curve that ranges between the curve $h_1$ and the curve $h_2$. That is, reducing the value of $\Delta t$ $(=t_1-t_0)$ causes the lift curve of the needle valve to approach the curve $h_2$ and increasing $\Delta t$ causes the lift curve to approach the curve $h_1$.

What is claimed is:

1. A fuel injection device for engines comprising:

a device body including nozzle holes at a front end thereof for injecting fuel;

a control sleeve fixed in a hollow portion of the device body;

a valve assembly having an end thereof inserted into a hole in the control sleeve, the end comprising a pressure receiving surface, the valve assembly including a needle valve reciprocally movable in the hollow portion of the device body and adapted to open and close the nozzle holes;

a balance chamber formed by the hole of the control sleeve and the pressure receiving surface of the valve assembly to control a lift of the valve assembly;

a supply passage formed in the control sleeve to supply a fuel pressure to the balance chamber;

an exhaust passage formed in the control sleeve to release the fuel pressure from the balance chamber; and a control means to open and close the exhaust passage;

wherein the control means includes a solenoid valve comprising a solenoid producing an electromagnetic force to open an exhaust port of the exhaust passage and a return spring mechanism having springs to apply spring forces to the solenoid valve to close the exhaust port;

wherein an effective opening area of the exhaust port of the exhaust passage opened by the solenoid valve is set smaller than a minimum cross-sectional area of the exhaust passage; and wherein the return spring mechanism comprises a first plate spring, a first spring retainer coupled to the first plate spring, a second plate spring spaced from the first plate spring in an axial direction of the needle valve, and a second spring retainer coupled to the second plate spring, and wherein the second spring retainer is disposed between the first plate spring and the second plate spring.

2. The fuel injection device for engines according to claim 1, wherein the first plate spring applies a first force to the solenoid valve in a direction of closing the exhaust port and the second plate spring, when the solenoid valve has moved more than a predetermined distance, applies a second force to the solenoid valve in the direction of closing the exhaust port.

3. The fuel injection device for engines according to claim 1, wherein the first plate spring and the second plate spring are formed in a same shape.

4. The fuel injection device for engines according to claim 1, wherein the first plate spring is installed, with an initial deflection, between the device body and a first spring retainer always in contact with the solenoid valve, and the second plate spring is installed between the device body and the second spring retainer, wherein the second spring retainer contacts the solenoid valve when the solenoid valve moves more than the predetermined distance.

5. The fuel injection device for engines according to claim 1, wherein in an initial stage of a fuel injection cycle an electric current applied to the solenoid is switched from a small current to a large current at a predetermined time after a start of the fuel injection cycle, wherein the small current has a first magnitude that causes the solenoid valve to move against only the first plate spring, and the large current has a second magnitude that causes the solenoid valve to move against both the first plate spring and the second plate spring.

6. The fuel injection device for engines according to claim 1, wherein the first plate spring and the second plate spring include a cone-shaped disc springs.

7. The fuel injection device for engines according to claim 1, wherein the first plate spring and the second plate spring are disposed in tandem.

8. The fuel injection device for engines according to claim 1, wherein reciprocal motion of the needle valve to open and close the nozzle holes is controlled by the control means.

* * * * *